US006851582B2

(12) United States Patent
Meyer

(10) Patent No.: US 6,851,582 B2
(45) Date of Patent: Feb. 8, 2005

(54) DEICING DEVICE

(76) Inventor: Lawrence C. Meyer, 37 Warren Dr., Hopewell Junction, NY (US) 12533

( * ) Notice: Subject to any disclaimer, the term of this patent is extended or adjusted under 35 U.S.C. 154(b) by 35 days.

(21) Appl. No.: 10/463,069

(22) Filed: Jun. 17, 2003

(65) Prior Publication Data

US 2004/0256412 A1 Dec. 23, 2004

(51) Int. Cl.[7] ..... B67D 5/64

(52) U.S. Cl. ..... 222/174; 222/175; 222/181.1; 222/561

(58) Field of Search ..... 222/174, 175, 222/180–181.2, 561

(56) References Cited

U.S. PATENT DOCUMENTS

| | | | | |
|---|---|---|---|---|
| 376,600 A | | 1/1888 | Leggett | |
| 1,289,505 A | * | 12/1918 | Mariner | 222/164 |
| 2,733,839 A | | 2/1956 | Blum | |
| 2,799,964 A | | 7/1957 | Childs | |
| 3,140,800 A | | 7/1964 | Henderson | |
| 3,730,402 A | | 5/1973 | Van Der Gaag | |
| 3,861,566 A | * | 1/1975 | Wentzell | 222/174 |
| 4,773,568 A | * | 9/1988 | Schaefer | 222/175 |
| 5,692,868 A | * | 12/1997 | Riemersma | 414/403 |

* cited by examiner

*Primary Examiner*—J. Casimer Jacyna

(57) ABSTRACT

A Deicing Device is provided for placing ice melting material into a rain gutter. The device is mounted on a handle and permits the placement of ice melting material from ground level without the need for a ladder. The Deicing Device has a front side which is placed over the rain gutter and the edge of the roof. On the rear side the actuating mechanism is located on the front side with a valve assembly and a spout. A valve plate which slides in a valve guide release deicing material from the hopper through the spout. A rope actuates the movement of the slide plate against the force of a spring. A support member is affixed to the hopper. A spring member is forced downwardly which forces a drive member, which is attached to the slide plate, toward the front side releasing deicing material in the hopper.

9 Claims, 5 Drawing Sheets

DEICING DEVICE

BACKGROUND OF THE INVENTION

1. Field of the Invention

This invention relates to an apparatus for dispersing deicing materials and more specifically to an apparatus for dispensing of deicing materials into rain gutters on a building.

2. Prior Art

In a colder climate where, at least for a part of the year, temperatures drop below freezing, the problem of ice in the rain gutters on a building, becomes a problem. Water in liquid form enters the gutters installed along the edge fo the roof and freezes into solid ice. Heat from within the building causes melting of snow and ice on the roof and the dripping from the roof then cannot be carried away by the rain gutters which are blocked by ice. It is also to be anticipated that the ambient temperature will rise just slightly over the freezing point and rain will fall but the ice which has previously frozen solid in the rain gutters does not melt sufficiently fast so that the gutters are available to carry away the melting snow and ice from the roof.

Various dispensing devices for granular material have been known. One example of such a device is shown in the Henderson Patent U.S. Pat. No. 3,140,800. The device taught in the Henderson Patent is intended for the measured dispersing of granulated material for agricultural purposes such as an insecticide. The Henderson Patent, which is apparently most desirable for its intended purposes, would not be suitable for de-icing and would, in any event, be too complicated and expensive for the deicing of rain gutters.

Deicing material is commercially available. Rock salt is a granular material for melting ice of long standing use. In more recent times, granular material purporting to have the ability to melt ice more rapidly than rock salt have also become commercially available.

It is apparent that someone desirous of melting ice in rain gutters could, by using a ladder, put ice melting material on the ice in the rain gutter. This, however, is time consuming and dangerous and many people are not physically capable of performing such a task.

Therefore, an apparatus which would permit the deicing of gutters and permit a person of limited strength to do so while standing on the ground, would be of great value.

OBJECTS

The objects of the invention are as follows:

To provide an apparatus to place deicing material on a rain gutter while standing on the ground.

To provide an apparatus for placing deicing material in a rain gutter that is simple to operate.

To provide an apparatus for deicing rain gutters which is easy to operate.

To provide an apparatus for deicing rain gutters which is durable and inexpensive to construct.

Still further objects and advantages of the present invention will be understood after consideration of the drawings, ensuing description and claims.

SUMMARY OF THE INVENTION

A deicing device is provided for placing ice melting material into a rain gutter. The deicing device has a front side, a rear side, a left side and a right side as well as an upper end and a lower end. The deicer device also has a hopper including a container, a valve assembly and a spout. The valve assembly is located between the spout and the container and the valve assembly and the spout are located at the lower end. The container and the spout each have an opening which openings are aligned with one another while the valve assembly includes means for opening and closing the openings in the container and the spout. A means is further provided for actuating the valve assembly and the deicing device is mounted on a handle. A bracket is mounted on the handle which bracket has two legs and a cross member. Each of the legs generally has the shape of an inverted U and the two legs being connected together by the cross member at the rear side. The two legs extend to the front side.

DETAILED DESCRIPTION OF THE DRAWINGS

DESCRIPTION OF THE NUMERALS

| NUMERAL | DESCRIPTION |
|---|---|
| 11 | Handle |
| 13 | Hopper |
| 15 | Brackets |
| 17 | Rope |
| 19 | Deicing Material |
| 21 | Container |
| 22 | Lower End (Container) |
| 23 | Upper End (Deicing Device) |
| 25 | Lower End (Deicing Device) |
| 27 | Right Side (Deicing Device) |
| 29 | Left Side (Deicing Device) |
| 31 | Front Side (Deicing Device) |
| 33 | Rear Side (Deicing Device) |
| 35 | Cap |
| 37 | Spout |
| 39 | Upper Section (Spout) |
| 41 | Lower Section (Spout) |
| 43 | Valve Assembly |
| 44 | Upper End (Valve Assembly) |
| 45 | Base Plate |
| 47 | Opening (Base Plate) |
| 49 | Slide Plate |
| 51 | Opening (Slide Plate) |
| 53 | Journal (Slide Plate) |
| 55 | Valve Guide |
| 57 | Opening (valve Guide) |
| 59 | Support Member |
| 61 | Front Edge (Support Plate) |
| 63 | Rear Edge (Support Plate) |
| 65 | Support Extension |
| 67 | End (Support Extension) |
| 69 | Flange |
| 71 | Threaded Opening |
| 75 | Spring Member |

-continued

| NUMERAL | DESCRIPTION |
|---|---|
| 77 | Spring Journal |
| 79 | Pulley Arm |
| 81 | Front End (Spring Member) |
| 83 | Rear End (Spring Member) |
| 85 | Spring |
| 87 | Point |
| 89 | Pulley Arm |
| 91 | Upper End (Pulley Arm) |
| 92 | Lower End (Pulley Arm) |
| 93 | Pulley |
| 95 | Drive Member |
| 97 | Rear End (Drive Member) |
| 99 | Front End (Drive Member) |
| 101 | Slot |
| 105 | Bracket Member |
| 107 | Clamp |
| 109 | Guide Pulley |
| 111 | Right Leg |
| 113 | Left Leg |
| 115 | Cross Member |
| 117 | Two Ends (Cross Member) |
| 118 | Rod |
| 119 | Protective Cap |
| 121 | Pull Member |
| 123 | Lower or Free End |

DETAILED DESCRIPTION OF THE PREFERRED EMBODIMENT

Figure 1:
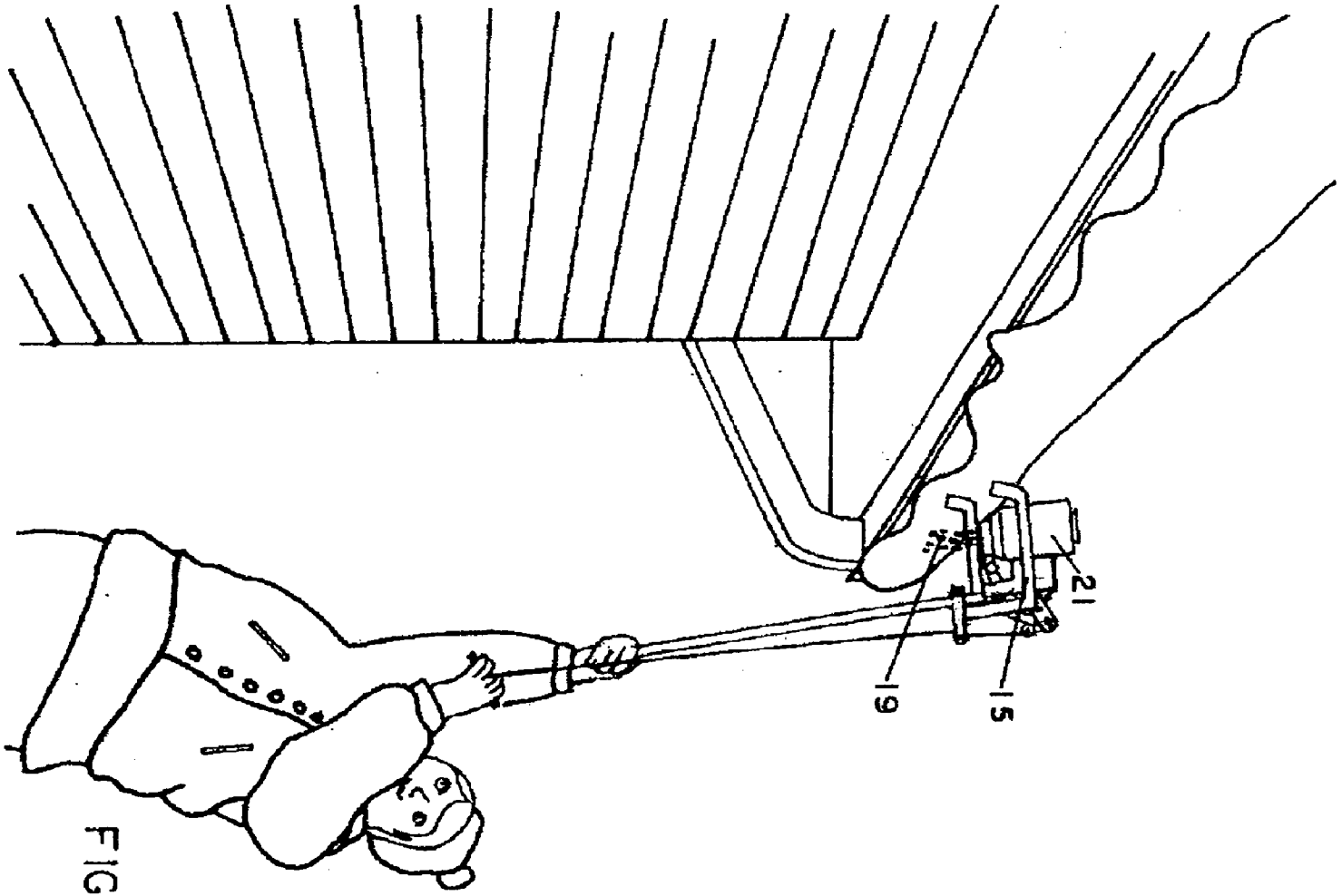
FIG. 1 is a pictorial view showing the Deicing Device in use with a person on the ground holding the device at the edge of the roof to dispense ice melting material into a rain gutter.

Referring now to FIG. 1, a building is shown having a rain gutter and a rain pipe for removing water from the roof. A person, who is standing at the ground level, is holding the Deicing Device at the edge of the roof with the Deicing Device resting on the edge of the roof.

The device is held by a handle 11 which is elongated. A hopper 13 is mounted on the handle 11 and a pair of brackets 15 rest on the roof to hold the Deicing Device securely over the rain gutter when being operated. A rope 17, whenvpulled actuates the release of the deicing material 19 from the hopper 13, as will be explained in detail hereinafter.

It should be understood that the Deicing Device works easily on a one story structure. With a handle 11 of strong but light construction, preferably one that is sectionalized, the Deicing Device can be utilized on a two-story building. Only a handfull of deicing material 19 is required every two or three feet to melt hard ice in the rain gutters.

Figure 2:
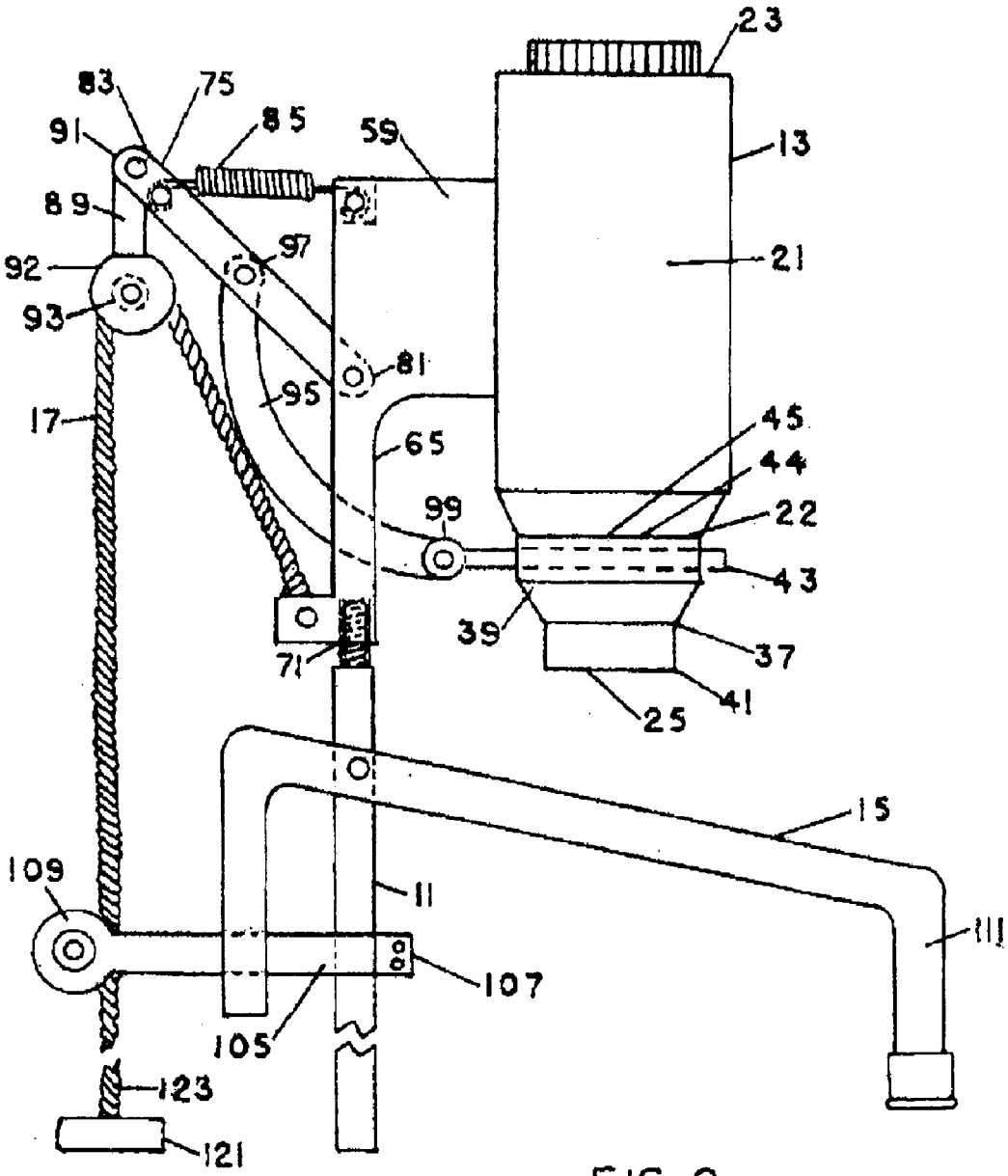
FIG. 2 is a side elevation of the Deicing Device showing the mechanism for directing release of the deicing material.
Figure 3:
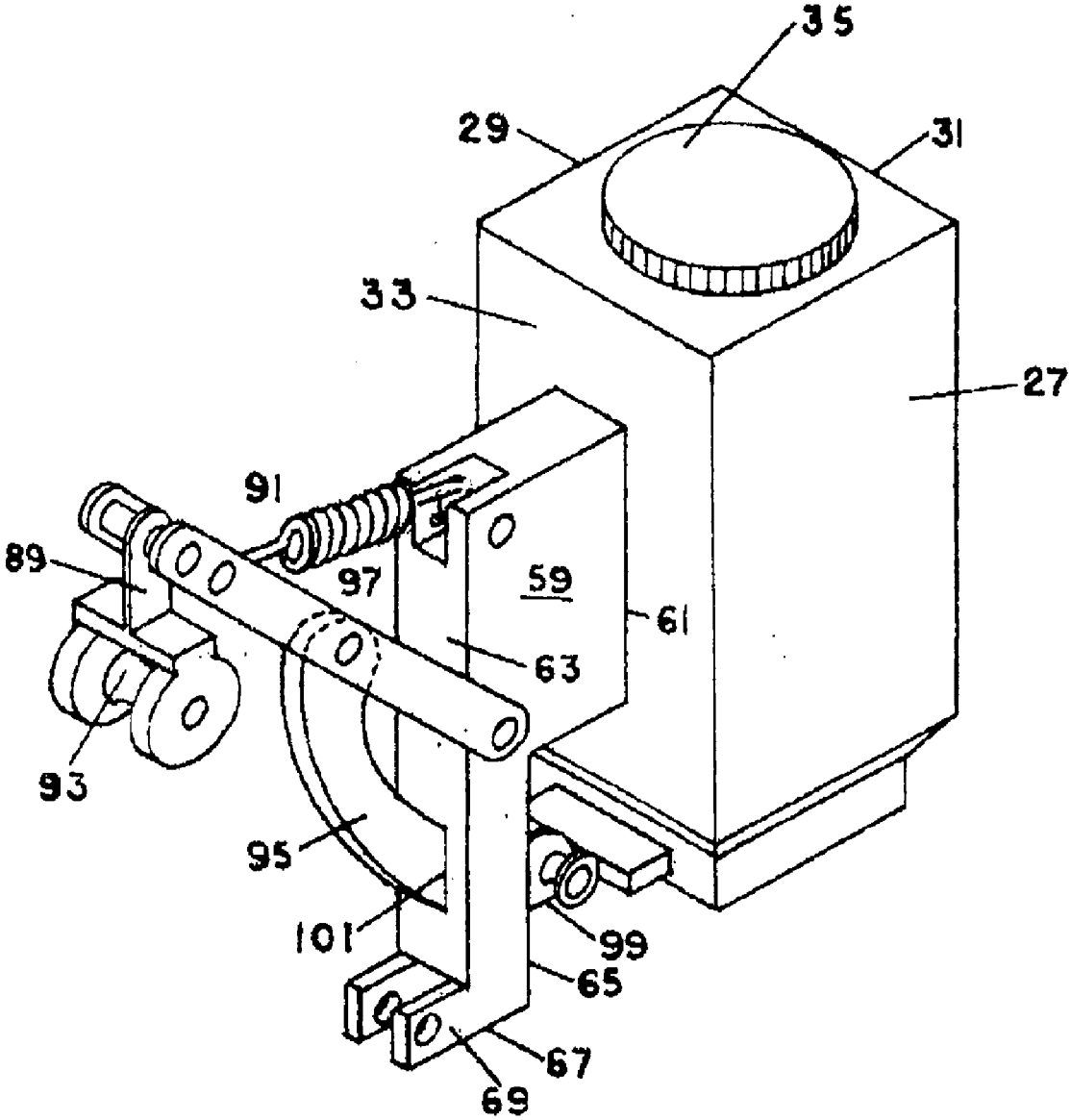
FIG. 3 is a perspective view of the Deicing Device showing the mechanism for releasing the deicing material.

Referring now to FIG. 2 and FIG. 3, the construction of the Deicing Device is shown. A hopper 13 includes a container 21 to hold the deicing material 19. The container 21 has a lower end 22. The Deicing Device has an upper end 23 and a lower end 25. The Deicing Device also has a right side 27 and a left side 29 consistent with the left side and right side of a person holding the Deicing Device on the edge of the roof. The Deicing Device further has a front side 31 which is placed on the roof and a rear side 33, opposite from the front side 31 These same designations pertain to the various components of the Deicing Device.

The hopper 13 includes a cap 25 at the upper end 23 which may be screwed into the hopper 13 or may be force fitted. At the lower end 25 of the hopper 13 is a spout 37 which has an upper section 39 and a lower section 41. The lower section 41 has a reduced diameter to cause the deicing material 19 to be directed into the rain gutter.

Figure 5:
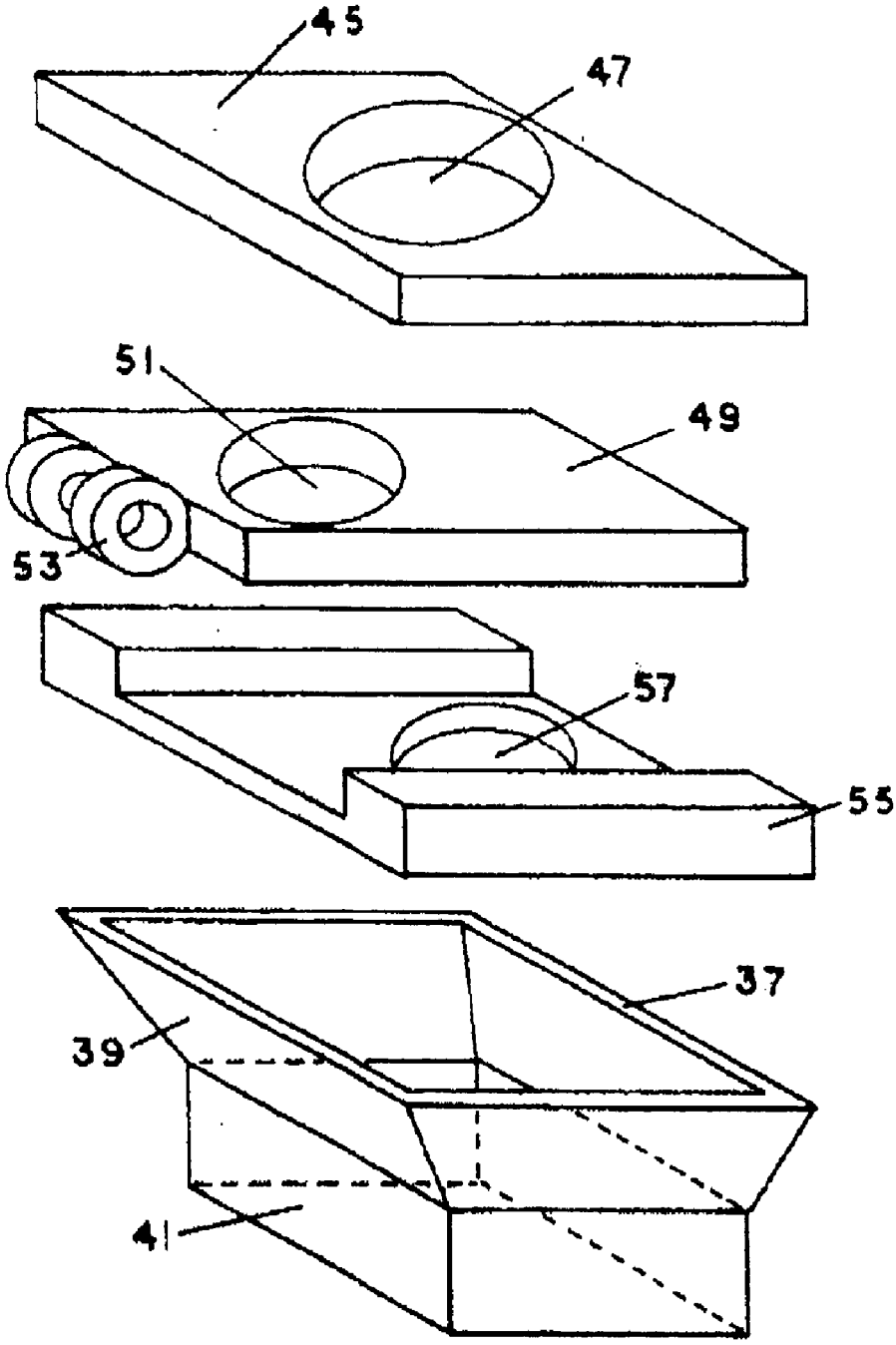
FIG. 5 is an exploded perspective view of the value assembly and the base plate of the hopper and the spout.

Between the spout 37 and the container 21 is a slide valve assembly 43 which controls the release of deicing material 19 from the container 21. The valve assembly 53 has an upper end 44 which is secured to the lower end 22 of the container 21. In FIG. 5, the valve assembly 43 is shown in an exploded view which clarifies the operation of the slide valve assembly 43. As seen in FIG. 5, and as has been previously discussed, the spout 37 is located beneath the valve assembly 43. The container 21 includes a base plate 45 located directly above the valve assembly 43 which is mounted directly beneath the base plate 45. The base plate 45 has an opening 47 through it which is preferably circular. A slide plate 49, which is part of the slide valve assembly 43, also has an opening 51 through it which is preferably circular. The slide plate 49 also has an opening 51 through it which is preferably circular. The opening 51 in the slide plate 49 and the opening 47 in the base plate 45 are not aligned with one another when the slide valve assembly 47 is in its inactive position.

The rear side 33 of the slide plate 49 has a journal 53 affixed to it. It should be noted that the slide plate 49 extends out toward the rear side 33 where the journal 53 is located. The slide plate 49 extends beyond the valve guide 55 and beyond the base plate 45 The slide plate 49 is situated in a valve guide 55. The valve guide 55 also has an opening 57 through it which is aligned with the opening 47 in the base plate 45 but not with the slide plate 49.

Returning to FIG. 2 and FIG. 3. a support member 59, which is a flat plate having a front edge 61, is affixed to the rear side 33 of the container 21 at the front edge 61. The support member 59 is aligned longitudinally with the container 21. The front edge 61 of the support member 59 extends along the central part of the rear side 33 of the container 21. The support member 59 also has a rear edge 63, which extends substantially beyond the front edge 61 due to a support extension 65 extending below the level of the spout 37 toward the lower end 25. At the end 67 of the support extension 65, a flange 69 is located which extends toward the rear side 33, away from the hopper 13 for a short distance. At the lower end 67 of the support extension 65 there is a threaded opening 71 into which the handle 11 is threaded.

A spring member 75 is also mounted on the support member 59 at the rear edge 63 of the support member 59 just above the support extension 65. The spring member 75 has a front end 81 and a rear end 83. The spring member 75 is situate at an angle to the hopper 13 and the support extension 65 with its rear end 83 located toward the upper end 23. The front end 81 of the spring member 75 is mounted on the support member 59.

A spring 85 extends from a point 87 adjacent to but spaced from the rear end 83 of the spring member 73 to the support member 59. The spring 85 is secured to the support member 59 at the upper end 23 and the rear edge 63 of the support member 75 59. The spring 85 also holds the front end 81 of the spring member 75 toward the upper end 23 of the Deicing Device when the spring 85 is relaxed.

The pulley arm 89 is mounted to pivot at its upper end 91. The lower end 92 of the pulley arm 89, as previously discussed, has a pulley 93 mounted on it. The pulley arm 89 extends from the spring member 75 with a generally vertical orientation.

As best seen in FIG. 3, a drive member 95 extends from substantially the middle of the spring member 75 to the slide plate 49. The drive member 95 is mounted at its rear end 97 to pivot on the spring member 75 and at its front end 99 on the slide plate 49. The drive member 95 is elongated and curved and extends downwardly from the spring member 75 and toward the slide plate 49. The support extension 65 has a slot 101 through it which permits the drive member 95 to pass through the support extension 65.

The handle 11 is secured into the threaded opening 71 at the end 67 of the support extension 65. Below the support extension 57, a bracket member 105 is affixed to the handle 11 by a clamp 107. The bracket member 105 extends away from the hopper 13 toward the rear 33 of the Deicing Device. A guide pulley 109 is located at the rear of the bracket member 105.

Figure 4:
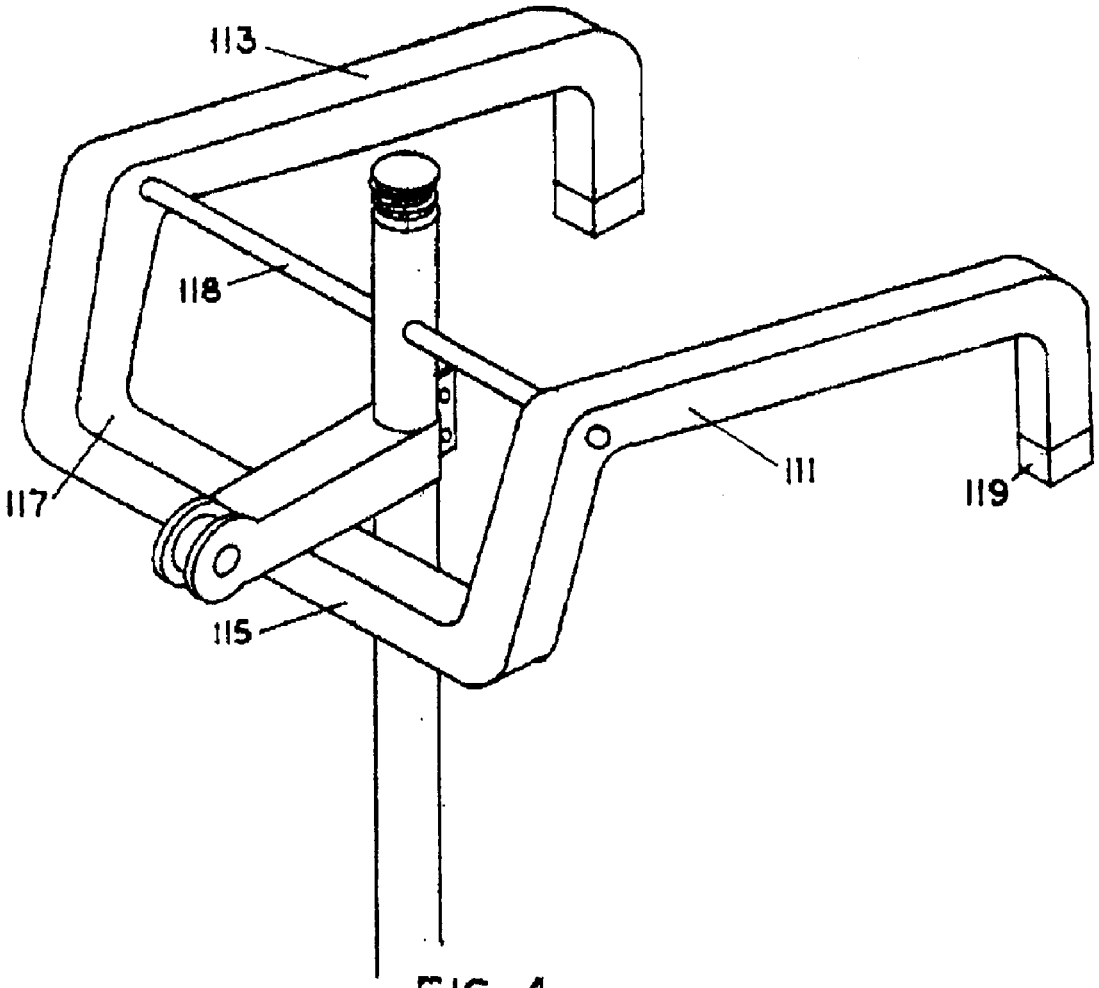
FIG. 4 is a perspective view of the roof brackets showing a portion of the pole and the bracket member which secures the roof bracket to the roof.

Secured to the bracket member 105 is the bracket 15 which has a right leg 111 and a left leg 113 as well as a cross member 115. The cross member 115 which has two ends 117, is secured to the right leg 111 and the left leg 113. The cross member 115 is secured at its ends 115 to the bracket member 105. Also, a rod 118 extends through the handle 15 and the right leg 111 and the lefty leg 113 to provide added security to the connection of th bracket 15 to the handle 11. Both the right leg 111 and the left leg 113 of the brackets are generally shaped like an inverted-U. As seen in FIG. 2 and FIG. 4, the right leg 111 and the left leg 113 of the brackets 15 extend under and to the right side 27 and the left side 29 of the spout 37 and beyond the spout 37 to the front side 31 of the Deicing Device and then extend down toward the lower end 25 generally in a vertical direction. Protective caps 119 are preferably is located on the right leg 111 and the left leg 113 to rest on the roof to support the weight of the Deicing Device.

The rope 17 which is flexible is affixed at one end to the flange 69 at the end 67 of the support extension 65. The rope 17 is passed over the pulley 93 affixed to the spring member 93 by means of the pulley arm 89. The rope 17 drops down and engages the guide pulley 109 located on the bracket member 105 and extends downwardly from that point for a distance determined by the height at which the Deicer Device is to be used and the height of the operator. A pull member 121 may optionally be located at the lower end 123 of the rope 17.

In operation, by means of the handle 11, the Deicing Device is hoisted up to the edge of the roof. The right leg 111 and left leg 113 of the bracket 15 are placed on the roof to hold the weight of the Deicing Device. The spout 27 is located directly over the rain gutter. With the Deicing Device in place, the rope 17 is pulled against the force of the spring 85. The rear end 83 of the spring member 75 drops toward the lower end 25 of the hopper 13 causing the rear end 97 of the drive member 95 to also move toward the lower end 25. The movement of the drive member 95 forces the opposite end of the drive member 95, which is connected to the slide plate 49, to move toward the front of the Deicing Device. In this way, the slide plate 49, which as previously discussed extends outwardly toward the rear of the Deicing Device, is forced toward the front side 33 of the Deicing Device. As a result, the opening 51 in the slide plate 49 aligns with the opening 47 in the base plate 45 and the opening 57 in the valve guide 55. Deicing material 19 in the container 21 is accordingly released and flows out of the spout 37 into the roof gutter. A small amount of deicing material every two or three feet rapidly melts the ice in the roof gutter.

It is to be understood that he drawings and descriptive matter are in all caes to be interpreted as merely illustrative of the principle of the invention, rather than as limiting the same in any way, since it is contemplated that various changes may be made in various elements to achieve like results without departing from the spirit of the invention or the scope of the appended claims.

What is claimed is:

1. A deicing device for placing ice melting material into a rain gutter, the deicing device having a front side, a rear side, a left side and a right side as well as an upper end and a lower end, the deicer device comprising:

a hopper including a container, a valve assembly and a spout, the valve assembly being located between the spout and the container, the valve assembly and the spout being located at the lower end, the container and the spout each having an opening which openings are aligned with one another, the valve assembly including means for opening and closing the openings in the container and in the spout;

means for actuating the valve assembly;

a handle;

means for securing the handle to the container; and a bracket mounted on the handle having two legs and a cross member, each leg generally having the shape of an inverted U, the two legs being connected together by the cross member at the rear side and extending to the front side.

2. A deicing device according to claim 1 wherein the hopper further includes a cap at the upper end.

3. A deicing device according to claim 1 wherein the valve assembly includes a valve guide and a slide plate mounted in the valve guide, the valve guide having an opening through it, the opening in the valve guide being at aligned with the openings in the container and in the spout, the slide plate also having an opening through it.

4. A deicing device according to claim 1 wherein the means for securing the handle to the container includes a support member.

5. A deicing device according to claim 1 wherein the means for securing the handle to the container includes a support member, a support member being a plate mounted on the hopper at the rear side, the support member further including a support extension extremely to the lower end in a spaced relationship to the container.

6. A deicing device according to claim 1 wherein the means for securing the handle to the container includes a support member and wherein the means for activating the value assembly includes:

a spring member being an elongated bar having a front end and a rear end, the front end being mounted to the pivot on the support member;

a spring extending between the support member and the rear end of the spring member;

a pulley assembly mounted on the rear end of the spring member; and a drive member being an elongated curved member having an upper end and a lower end, the upper end of the drive member being mounted to rotate on the spring member and the lower end of the drive member being connected to the valve assembly.

7. A deicing device for placing ice melting material into a rain gutter, the deicing device having a front side, a rear side, a left side and a right side and a lower end and an upper end, the deicing device comprising:

a hopper having a upper end and a lower end, and including a container, a cap being located at the upper end of the container to provide access to the container;

a valve assembly mounted on the lower end of the valve assembly including a valve guide and further including a slide plate mounted in the valve guide, the valve guide having an opening through it, the opening in the base plate and the opening in the valve guide being aligned with one another;

a spout mounted in the lower end of the valve assembly, the container having a base plate at its lower end, the base plate having an opening through it;

a support member affixed to the container, the support member including a threaded opening;

a handle mounted on the threaded opening;

a rope having an upper end and a lower end, the upper end being secured to the support member, the rope engaging the means for activating the valve assembly;

a means for activating the valve assembly;

a bracket having two legs, each leg generally having the shape of an inverted U, the two legs being connected together by a cross member at the rear side, and extending to the front side; and a means for connecting the bracket to the handle.

8. A deicing device according to claim 7 wherein the means for activating the valve assembly includes:

a spring member being an elongated bar having a front and and a rear end, the front end being pivotally mounted on the support member;

a spring extending between the support member and the rear end of the spring member;

a pulley assembly including a pulley and a pulley arm, the pulley arm having a lower end and an upper end, the pulley being affixed to rotate on the lower end of the pulley arm, the upper end of the pulley arm being mounted to rotate on the rear end of the spring member;

a drive member being an elongated curved member, the drive member being an elongated curved member, the drive member having an upper end and a lower end, the upper end of the drive member being mounted to rotate on the spring member generally midway between te rear end and the front end of the spring member, the lower end of the drive member being mounted on the slide plate.

9. A deicing device for placing ice melting material into a rain gutter, the deicing device having a front side, a rear side, a left side and a right side and lower end and an upper end, such deicing device comprising:

a hopper having an upper end and a lower end, including a container, a cap, at the upper end of the hopper to provide access to the container and a spout a the lower end of the hopper for dispensing ice melting material, the container having a base plate with an opening through it;

a valve assembly mounted between the container and the spout, the valve assembly including a valve guide and further including a slide plate mounted in the valve guide, the valve guide having an opening through it, the opening in the base plate and the opening in the valve guide being aligned with one another, the slide plate being located between the base plate and the valve guide and having an opening through it;

a support member affixed to the container, the support member including a threaded opening;

a handle mounted in the threaded opening;

a spring member being an elongated bar having a front end and rear end, the front end being pivotally mounted on the support member;

a spring extending between the support member and the rear end of the spring member;

a pulley assembly including a pulley and a pulley arm, the pulley arm having a lower end and an upper end, the pulley being affixed to rotate on the lower end of the pulley arm, the upper end of the pulley arm being mounted to rotate on the rear end of the spring member;

a drive member being an elongated curved member, the drive member having an upper end and a lower end, the upper end of the drive member being mounted on the spring member generally midway between the outer end and the inner end of the spring member, the lower end of the drive mounted on the slide valve;

a bracket member secured at one end to the handle; and a bracket having two legs and a cross member, each leg generally having the shape of an inverted U, the two legs being connected together by the cross member at the rear side, the two legs extending to the front side, the cross member being secured to the bracket member.

* * * * *